US006199692B1

(12) United States Patent
Van Ness et al.

(10) Patent No.: US 6,199,692 B1
(45) Date of Patent: Mar. 13, 2001

(54) REDUCED MATERIAL BOX DESIGN FOR ROUND OBJECTS

(75) Inventors: William Van Ness, Saddle River, NJ (US); Glenn Thresher, Big Flats, NY (US)

(73) Assignee: Van Ness Plastic Molding Inc., Clifton, NJ (US)

( * ) Notice: Subject to any disclaimer, the term of this patent is extended or adjusted under 35 U.S.C. 154(b) by 0 days.

(21) Appl. No.: 08/644,895

(22) Filed: May 10, 1996

(51) Int. Cl.[7] ..... B65D 85/00
(52) U.S. Cl. ..... 206/315.9; 206/780
(58) Field of Search ..... 206/315.9, 315.91, 206/485, 779, 780

(56) References Cited

U.S. PATENT DOCUMENTS

D. 350,693 * 9/1994 Pratt ..... D9/415
2,890,790 * 6/1959 Gibson, Jr. .
3,815,735 * 6/1974 Cucuo ..... 206/485
3,987,893 * 10/1976 Hanson ..... 206/45.14
4,315,569 * 2/1982 Jaeschke ..... 206/45.31
4,570,787 * 2/1986 Forbes, Jr. ..... 206/485
4,778,179 * 10/1988 Balaz ..... 206/315.1
5,322,210 * 6/1994 Chila et al. ..... 206/315.9
5,485,913 * 1/1996 Steinfels, III ..... 206/45.19
5,695,056 * 12/1997 Bender et al. ..... 206/315.9

* cited by examiner

*Primary Examiner*—David T. Fidel
(74) *Attorney, Agent, or Firm*—Thomas A. O'Rourke

(57) ABSTRACT

Improved carton construction for spherical objects is disclosed. The carton has front and rear wall panels joined by side panels and top and bottom panels. The front and rear wall panels have a centrally located opening to permit a portion of the spherical article housed within the carton construction to be displayed. The cross-sectional area of the top panel is equal to or only slightly greater than the cross-sectional area of the sphere that is being packaged therein.

9 Claims, 6 Drawing Sheets

REDUCED MATERIAL BOX DESIGN FOR ROUND OBJECTS

As natural resources diminish and become more costly, the public and industry are becoming more concerned and making decisions about environmental issues concerning the products they use and the products they make. One area where environmentalists and the general public have become more vocal over the years has been in the area of excessive product packaging. Environmentalists and the public have objected on numerous instances to superfluous packaging that wastes important natural resources whether it be petroleum for plastic packaging or trees in paperboard or cardboard packaging. Once superfluous packaging was more common only with respect to expensive products. Unfortunately, over time the concept has expanded to more mundane items.

Apart from the issue of unnecessary packaging, there frequently are other competing considerations in packaging that preclude a completely minimalist approach to package design. For small objects that could be readily subjected to theft or misplacement, package design can help minimize the risk. For example, small compact disks and cassette tapes are frequently packaged in boxes larger than the tape or the CD or tape to make it more difficult to steal by hiding the products in handbags or pockets.

Another consideration that must be factored into a package design is the aspect of product display. Packaging is also a medium of advertising to help convince the public to make a purchase. For many items, it is also advantageous from a marketing standpoint to permit the potential purchaser to view as much of the product as possible to enhance marketability particularly where the product has unique features that packaging can emphasize. Alternatively, some manufactures use packaging to hide the size or quantity of a product from consumers by using large packaging that creates a false impression.

Product placement in the marketing environment must also be taken into consideration in packaging decisions. Retail store owners have more products available to be displayed than they frequently have room on the shelf space. Furthermore, depending on the product, premium display space is at eye level and this space is usually the most desirable and the least available. Packaging design can also enhance the products chance of securing placement in the favorable display area that will give the product its best chance for purchase. Many package designers, as a result, rely, for example, on color to draw the purchaser's eyes to the products. Another factor that is important to store owners and manufactures together is the ability of a store owner to display sufficient quantities of good selling products so that there are not unnecessarily long periods where the shelf space is empty and these products are not on the shelf because the quantity originally displayed has been sold. Store owners and manufactures wish to be able to have as much product as possible in given area so that the risk of out of stock on the shelf is minimized.

One of the more difficult items to display have been round or spherical objects such as balls. One common way of displaying balls for sale is to have a bin or other receptacle available where all of the balls of a particular type may be presented. A problem with bins is that when a great quantity of balls are to be displayed the walls of the bin's tend to be too high so that as the balls at the top are sold, the purchasing public has difficultly in reaching the lower balls. If the bin's walls are too low insufficient stock may be displayed. Many store owners also object to the use of bins for round objects particularly when the objects are of different designs or colors. Customers sifting through the bins tend to drop balls which then roll around the store soiling the product and generally get in the way of traffic in the aisles.

Smaller balls such as golf balls are usually not packaged individually. Larger balls are usually packaged in a variety of ways. One approach to package these larger balls is to wrap them in a cardboard or paperboard box. The advantage of this box is that it is stackable on a store shelf and it protects the balls from blemishes during shipment and handling.

Another approach to packaging larger balls is a plastic bag or pouch. The advantage of the plastic bag is low cost, but there are drawbacks. One of the drawbacks is the susceptibility of the packaging material to tears, rips or punctures. In selecting a plastic material that is easy to open there is the tradeoff that the packaging material is usually thin and easy to rip. Another disadvantage is that the balls packaged in plastic bags or pouches are not stackable and subject to movement or rolling when displayed on a shelf.

More recently, balls have been packaged in a heavy polypropylene blister pack. The blister pack has the advantage of being clear so the product can be seen and but it is a costly packaging material. One disadvantage to blister packs is the difficulty of opening the package. Many people complain that blister packs are almost impossible to open unless an extremely sharp instrument is used. Even when a sharp object is used there is a risk of injury from the sharp object. Blister packs can have an additional drawback which is the inability to stack them. Many products when packaged in blister packs are only able to be displayed by hanging on a rod in the store. While this usually gives the product a good selling location as the product can be close to eye level, hanging the product on a rod, particularly bulky items, prevents a quantity items from being hung from the rod because of the weight of the product. Due to the need to provide an area in the blister pack for the pack to hang from a rod the blister pack also tends to be significantly larger than the corresponding cardboard or paperboard box. Another drawback to blister packs is that because these packages must hang from a rod there are restrictions on the number of items that can be hung from the rod. As a result, store owners have a dilemma on the use of blister packs. Since only a few can be hung from a rod the store owner must either run the risk that the display may run out of product at times because insufficient numbers are displayed or devote additional space to the item by way of multiple rods for hanging the product. This is difficult for the store owner because unless the item packaged in the blister pack is a high margin item and a high volume seller, there is a reluctance to devote too much shelf space to each item. As a result, there is a need for packaging for spherical objects such as balls.

There are a number of prior art packaging approaches to round objects such as balls. For example, U.S. Pat. No. 4,779,726 to Pratt discloses a package formed from a blank of cardboard having two square panels, two rectangular panels and two triangular panels. The rectangular panels have circular recesses open to the edges and the blank is folded such that the recesses lie in perpendicular intersecting planes so the spherical article can be engaged and supported between opposed recesses.

In U.S. Pat. No. 3,987,893 to Hanson there is disclosed a one piece paperboard blank for forming a display carton capable of packaging an article such as a ball so that opposed surfaces of the article are exposed. There is a solid top bottom and side panels. The back panel is defined by specially curved portions articulated to the top and bottom panels. The lock panels and the curved panels are interconnected by intermediate articulate webbed corners.

U.S. Pat. No. 2,939,622 to Ippolito relates to packages for fragile containers such as glass flasks, jars and bottles. Other patents that relate to packaging curved or spherical objects include U.S. Pat. Nos. 3,363,747 to Nowak, 2,890,790 to Gibson, 3,767,043 to Margolis, 3,815,735 to Cucuo and 4,315,569 to Jaeschke.

None of the prior art and patents have an appreciation however, of the modern packaging requirements in the display, packaging and stacking of spherical objects such as balls so that they can be advantageously displayed.

The present invention is directed to an improved paper board, cardboard or plastic package that provides and box that uses reduced amounts of packaging material to satisfy environmental concerns on excess packaging, yet at the same time, provides a package that fully displays the product and permits the packages to be stacked.

OBJECTS OF THE INVENTION

It is an object of the present invention to provide a package that reduces the amounts of packaging material used to package spherical objects.

It is also an object of the present invention to provide a package that permits spherical objects to be stacked one on top of the other.

It is a further object of the present invention to provide a package that fully displays the desirable attributes of the products to be packaged.

It is also a further object of the invention to provide a package that can package spherical objects using minimal amounts a packaging material.

SUMMARY OF THE INVENTION

The objects of the present invention are achieved by a box for packaging spherical objects such as balls which box has six, generally planar surfaces. Four of the planar surfaces, the top, bottom and two sides are generally rectangular in shape. The remaining two surfaces, the two face walls or panels, are generally square. The face panels are provided with a substantially round or circular cut out portion where a substantial portion of the ball protrudes therethrough to permit viewing of the ball when the ball is packaged.

The top and bottom of the box are generally rectangular in shape and have an length ($l_1$) and a width ($w_1$) . The side walls of the box are also generally rectangular with a height ($h_1$) which is substantially equal to the length ($l_1$). The side walls also have a width ($w_2$) which is substantially equal to the width ($w_1$) of the top of the box. The face panels or walls are generally square and have a height ($h_2$) and length ($l_2$) such that the height ($h_2$)=length ($l_2$) and both are substantially equal to length ($l_1$) of top and bottom of the box.

DETAILED DESCRIPTION OF THE DRAWINGS

Figure 1:
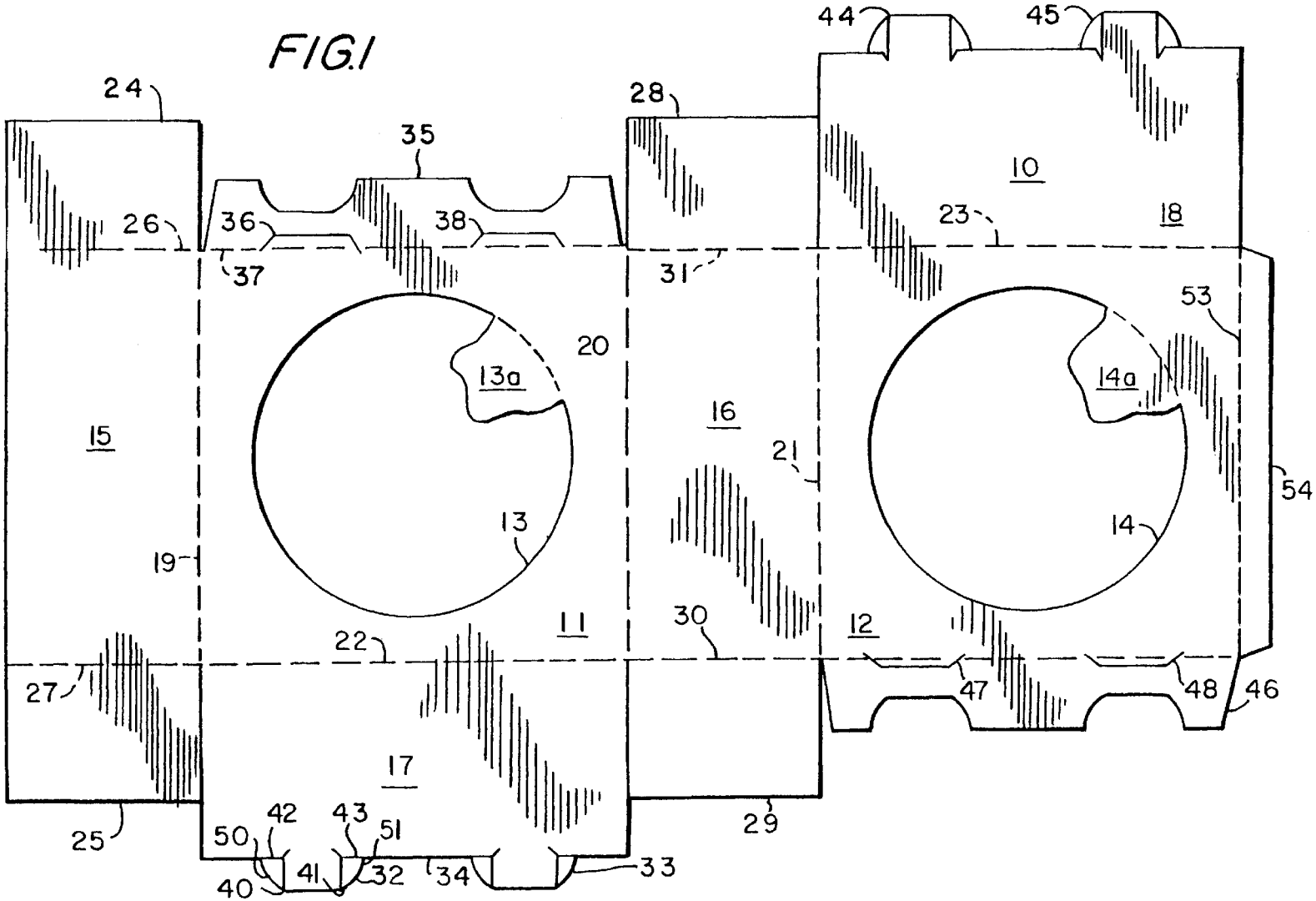
FIG. 1 is a plan view of a blank for forming the carton construction of the present invention.
Figure 2:
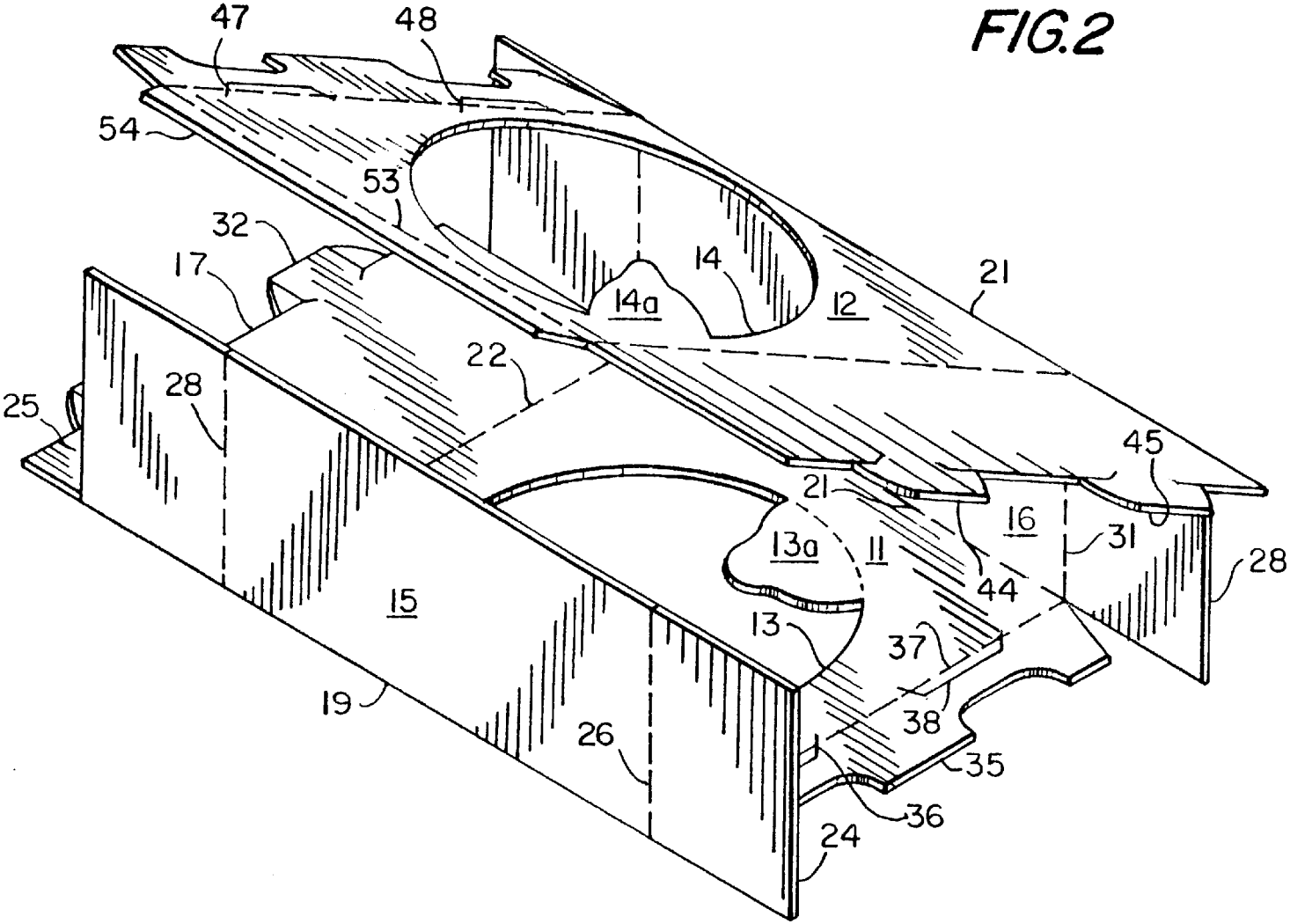
FIG. 2 is a perspective view of a partially formed carton of the present invention.

Referring to the drawings in detail, the carton 10 of the present invention is used to house and display a spherical object such as a ball. One product which this invention is particularly adapted for is the packaging of hamster exercise balls. Hamster exercise balls are round usually translucent balls generally made of a plastic material which a pet such as a hamster or other small animal may be placed. Once in the ball, the animal can run in the ball causing the ball to travel across the floor or other surface. Hamster or pet exercise balls are particularly adapted for the present invention because these items are given bright colors to attract the purchaser's attention and the customer desires to see the construction of the hamster ball particularly in the area of entrance and egress for pet in the ball.

Figure 3:
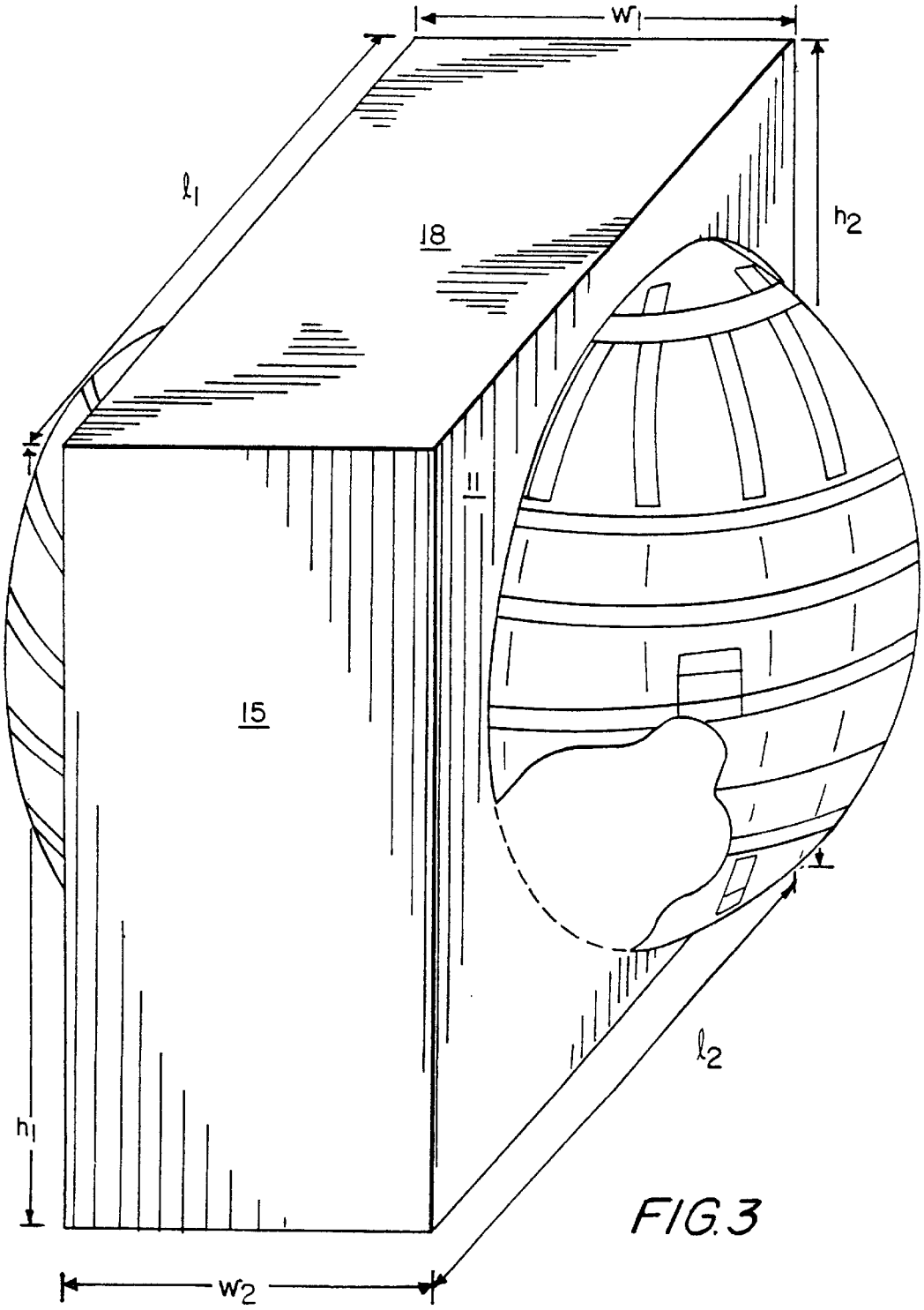
FIG. 3 is a perspective view of the carton construction of the present invention.

FIG. 1 shows a carton 10 which may be made of any suitable flexible material such as paperboard, cardboard or plastic sheet, Carton 10 includes a front wall panel 11 and a rear wall panel 12 each having arcuate portions 13 and 14 cut out of the center area of these panels. The purpose of the cut out arcuate portions is to permit the spherical object to protrude from the box for display purposes as shown in FIG. 3. The arcuate portions 12 and 14 may be a complete circle or only a partial circle as shown in FIG. 1. The portion of the carton or tabs 13*a* and 14*a* that extend into the cut out area may be used for advertising purposes or to highlight attributes of the product that are desired to be emphasized.

Foldably connected to the front wall panel 11 are a pair of side wall panels 15 and 16. On the edge of sidewall panel 16, opposite the edge to which wall panel 11 is connected, is rear wall panel 12. Side wall panel 16 is foldably connected to rear wall panel 12. Side wall panel 15 is foldably connected to front wall panel 11 by score line 19. Side wall panel 16 is foldably connected to front wall panel 11 and rear wall panel 12 by score lines 20 and 21 respectively. Bottom wall panel 17 is foldably connected to the bottom of front wall panel 11 by score line 22 and top wall panel 18 is foldably connected to the top of rear wall panel 12 by score line 23. Side wall panel 15 has pair of tuck flaps 24 and 25 extending from each end. The flaps 24 and 25 are foldably connected to side wall panel 15 by score lines 26 and 27 respectively. Side wall panel 16 also has a pair of tuck flaps 28 and 29. These tuck flaps are foldably connected to side wall panel 16 by score lines 30 and 31 respectively. At the end of the front wall panel 11 opposite bottom wall panel 17, a tuck end flap 35 is provided. Tuck end flap 35 is foldably connected to the top of front wall panel 11 by score line 37. Tuck lock flaps 32 and 33 extend from outer edge 34 on bottom wall panel 17. The tuck lock flaps 32 and 33 are adapted to pass through tuck end flap 35 by passing through slits 36 and 38. Tuck end flaps 32 and 33 may be provided with score lines 40 and 41 which are generally perpendicular to edge 34. Tuck lock flaps 32 and 33 are partially separated from edge 34 of bottom wall panel 17 by cut portions 42 and 43. The edge 50 of tuck lock flap 32 and 33 may be folded about the score lines 40 and 41 when the tuck end flaps 32 and 33 are inserted into slits 36 and 37. The folding of the tuck lock flaps 32 and 33 helps retain these flaps in the slips 36 and 37 like a bayonette type closure when the box is formed.

Top wall panel 18 also has a pair of tuck lock flaps 44 and 45. Similarly at the end of rear wall panel 12 opposite top wall panel 18 there is a tuck end flap 46. Tuck end flap 46 has a pair of slits 47 and 48. Tuck lock flaps 44 and 45 pass through slits 47 and 48 to form the carton of the present invention. Extending from score line 53 on wall panel 12 is end panel 54 which may be adhered to the side wall 15 when the carton is formed. The panel end panel 54 may be adhered to side wall 15 by any suitable means such as adhesive or glue.

As can be seen from the drawings, the top wall panel of the box is generally rectangular in shape and has a length ($l_1$) and a width ($w_1$). The side wall panels of the carton 15 and 16 are also generally rectangular with a height ($h_1$) which is substantially equal in length to the length ($l_1$) of the top wall panel. The side wall panels also have a width ($w_2$) which is substantially equal to the width ($w_1$) of the top wall panel. The front and rear front wall panels 11 and 12 are generally square and have a height ($h_2$) and a length ($l_2$) such that such that the height ($h_2$)=length ($l_2$) of the front and rear panels 11 and 12. The bottom wall panel 17 is generally identical to the top wall panel. The relationship of the dimensions of the panels may be expressed as follows:

1) $l_1=l_2=h_1=h_2$

2) $w_1=w_2$

One important aspect of the packaging of the present invention is the selection of the size of the carton to properly package the spherical object so that the spherical object is firmly retained in the package without undue movement during shipment yet using a minimum amount of packaging material. Accordingly, the relationship of the cross sectional area of the sphere through its center point to the area of the top wall panel should be approximately equal.

The cross-sectional area ($A_1$) of the sphere measured at its widest point i.e. through its center point is $A_1=\pi R^2$ where R is the radius of the sphere. The area of the top wall panel may be expressed as $A_2=l_1\times w_1$. Thus in one embodiment $l_1\times w_1\sim\pi R^2$and preferably, the two are equal to each other or $A_1$is only slightly less than $A_2$. It should be noted that the closer the area $A_2$ of the top wall panel approaches the Area $A_1$ of the sphere the better the sphere will fit in the package. Similarly where $A_2$ is significantly greater than $A_1$ there is a risk that too much packaging material will be used.

Figure 4:
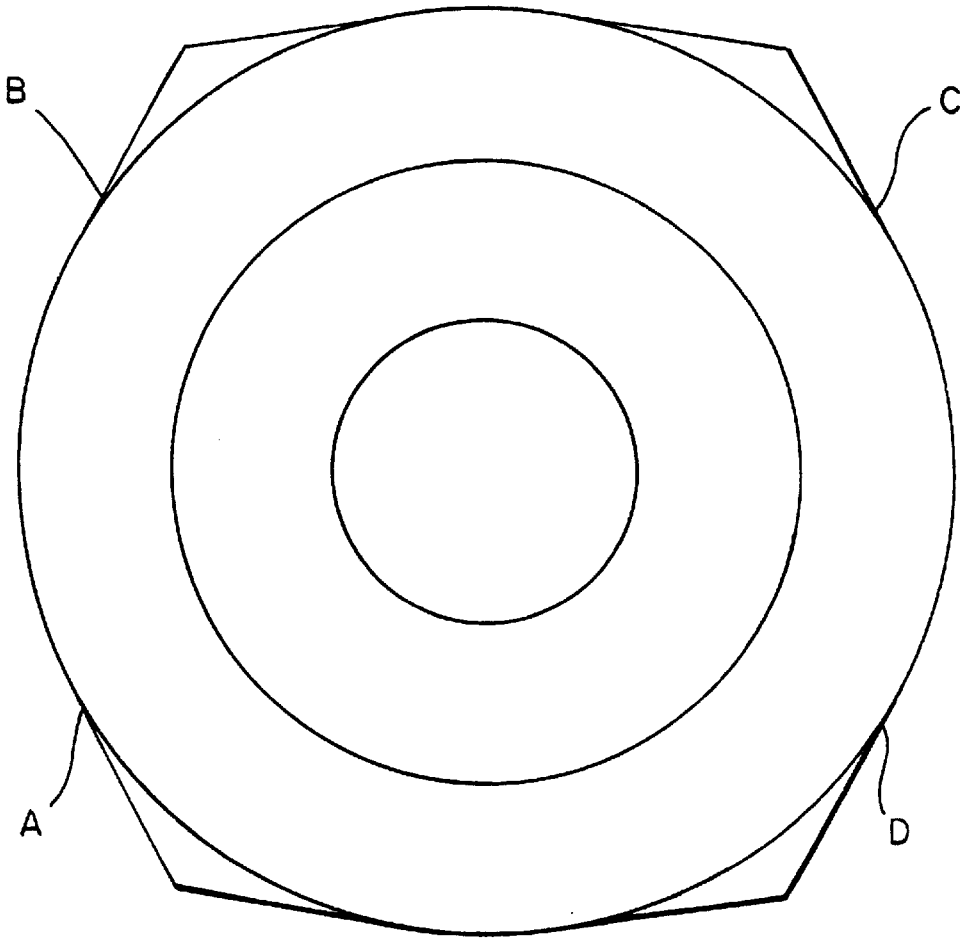
FIG. 4 is a top cut away view of the top edge of the carton with a spherical object partially inserted.

As can be seen in FIG. 4 the circumference of the spherical object is only slightly less than the perimeter of the box opening. The closer the circumference of the sphere is to the perimeter of the box opening without being greater than the perimeter the better the spherical object will be able to fit in the box for purposes of this invention. In fact, as seen in FIG. 4 because the walls of the carton are flexible, the perimeter P which may be expressed as 2 ($l_1\times w_1$) of the opening becomes almost circular as the ball is inserted. In fact, any point on the arc AB to a point on the arc CD directly opposite thereto is the same as the diameter of the sphere that is being packaged. Thus 2 ($l_1\times w_1$)$\sim 2\pi R$. $2\pi R$ which represents the circumference of the spherical object and R is the radius of the spherical object.

When the ball is placed through the top wall panel the bottom does not become so distorted that the tuck end flap comes apart when the from the remainder of the carton. Preferably, the material used for the container is flexible without being permanently distorted when a spherical objects is inserted.

Figure 5:
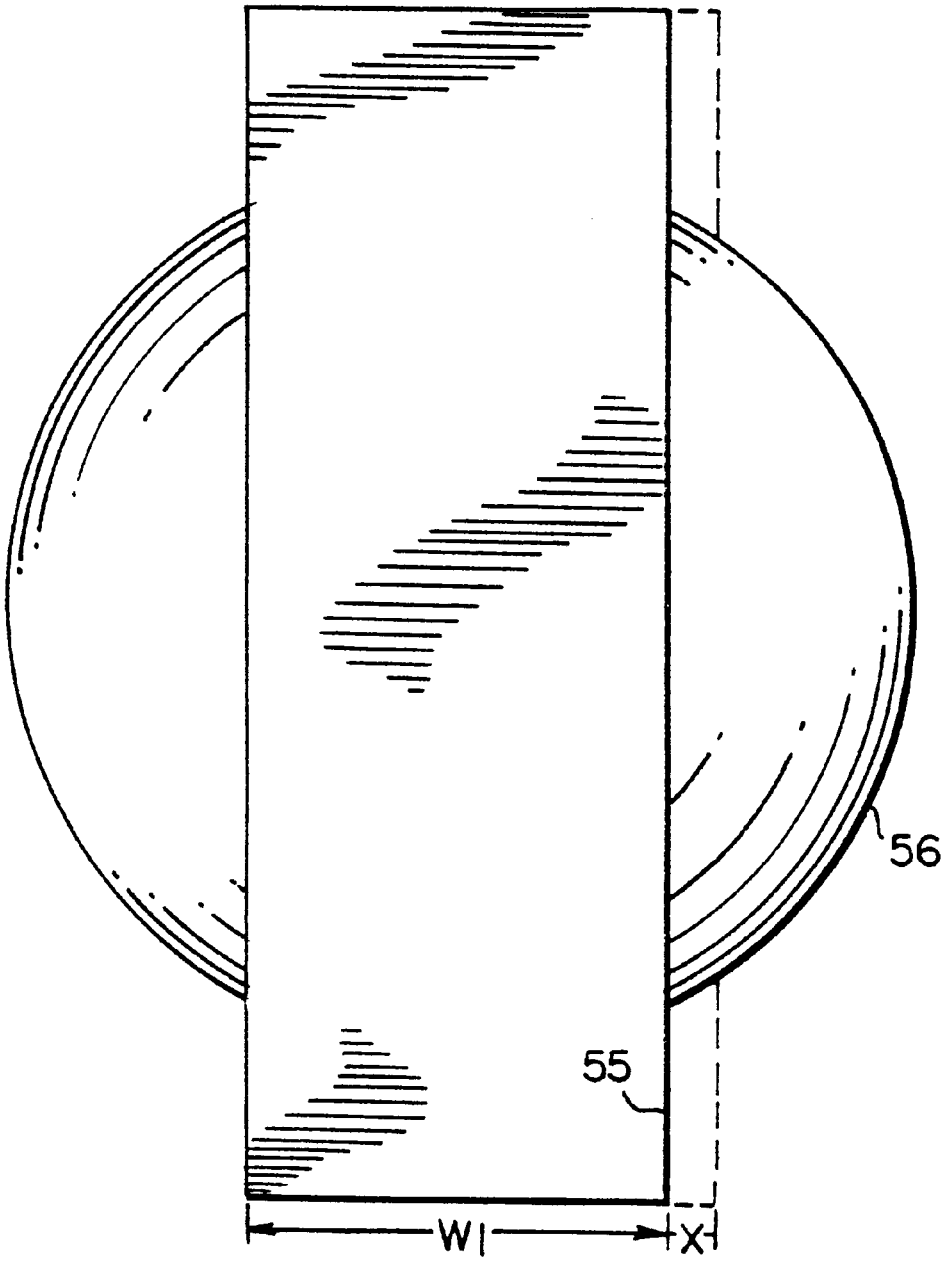
FIG. 5 is a top view of the carton with a spherical object inserted.
Figure 6:
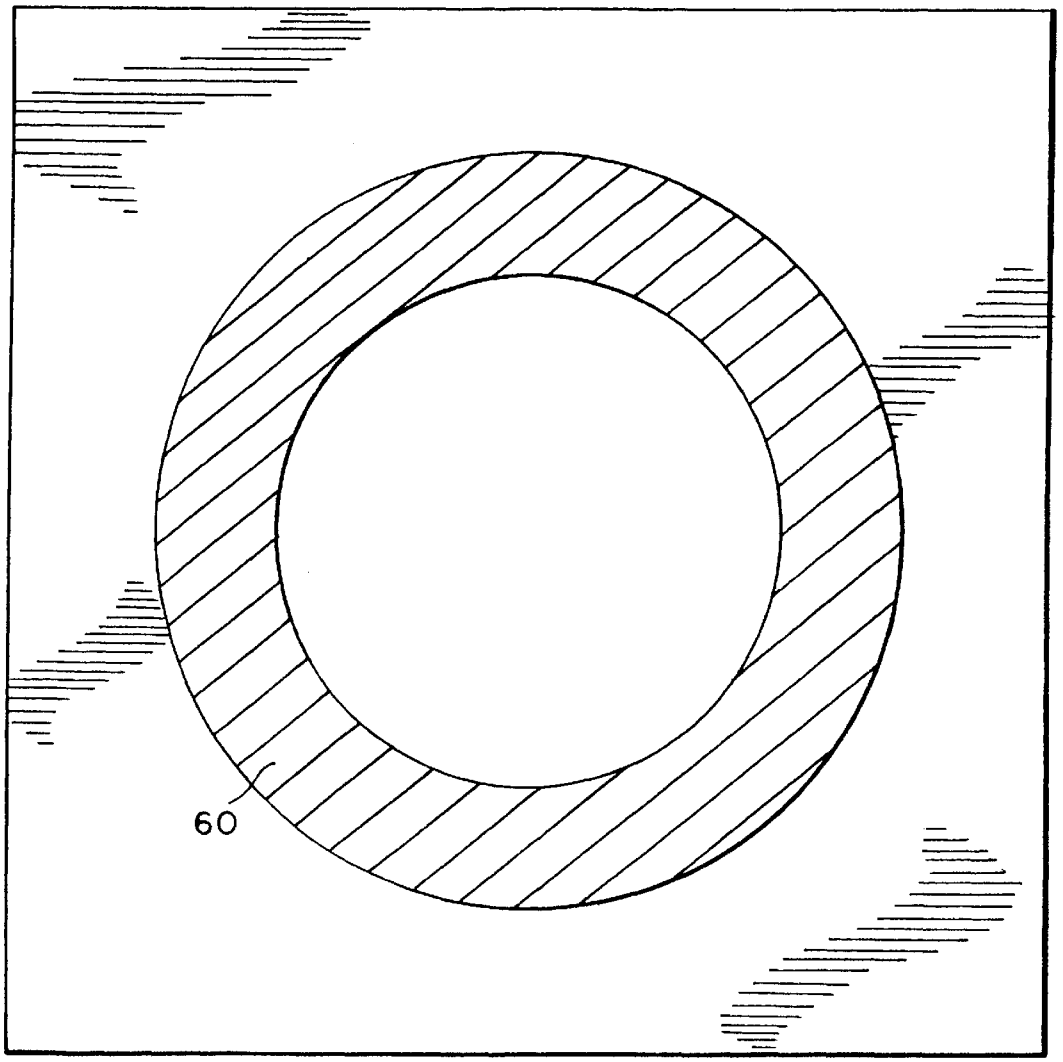
FIG. 6 is a front view of the carton of the present invention showing how the viewing area decreases as the width of the carton increases.

The arcuate area on the front and rear wall panels is preferable of a diameter $d_2$ such that a sufficient portion of the sphere extends through the front and rear wall panels so that the sphere can fit in the carton. However, the width $W_1$ of the side panel should be less than the diameter of the sphere to be packaged and should preferably be equal to or only slightly greater than the radius of the sphere to be packaged. If the width $w_1$ is equal to or greater than the radius of the sphere a more stable carton is formed. In addition, it should be noted as $w_1$ increases in size the portion of the spherical object that may be viewed through the arcuate area diminishes considerably as seen in FIG. 5 where 55 is the edge of the front wall panel 56 is the portion of the spherical object extending out from the arcuate area. As $w_1$ is increased by a distance X (represented by the dotted lines) the viewing area decreases. The viewing area is decreased significantly as the width $W_1$ increases. As seen in FIG. 6 the shaded area 60 demonstrates the reduction in viewing area as $W_1$ is increased. Accordingly, the width $w_1$ should be as small as possible so that the box may stand upright on a flat surface when it contains a spherical object so that as much of the spherical object may be viewed through the arcuate area.

We claim:

1. A carton construction comprising:

a front wall panel having a top edge and a bottom edge and a pair of side edges parallel to each other;

a rear wall panel having a top edge and a bottom edge and a pair of side edges parallel to each other;

a first sidewall panel having a pair of parallel edges, said sidewall panel being connected at said edges to one of said side edges on each of said front and rear wall panel;

a second sidewall panel having a pair of parallel edges, said sidewall panel being connected at said edges to the opposite edge of said front wall panel and said edge of said rear wall panel;

said side wall panels having a top edge and a bottom edge;

a top panel foldably connected to one of said wall panels;

a bottom panel foldably connected to the other of said wall panels;

a centrally located opening on said front and rear wall panels adapted permit a portion of a spherical article housed within the carton construction to be displayed;

a tuck end flap on each of said top and bottom panels and wherein the area of the top panel is at least equal to or greater than the cross sectional area of a sphere to be packaged therein.

2. The carton according to claim 1 wherein said top and bottom panels and said sidewall panels are rectangular in shape and said front and rear wall panels are square in shape.

3. The carton according to claim 2 wherein said area of the top panel is substantially equal to the cross sectional area of a sphere to be packaged in said carton.

4. The carton according to claim 1 wherein said top and bottom panels have a length ($l_1$) and a width ($w_1$) and said side panels have a height ($h_1$) and a width ($w_2$) and said front and rear wall panels have a length ($l_2$) and a height ($h_2$) wherein the relationship of the panels is expressed as $l_1=l_2=h_1=h_2$ and $w_1=w_2$.

5. The carton according to claim 4 wherein the circumference C of the spherical object is represented by $2\pi R$ where R is the radius of the sphere and the perimeter P of the carton is represented by $2(l_1\times w_1)$ and wherein $P\geqq C$.

6. The carton according to claim 1 wherein said front and rear wall panels are capable of being distorted at said top edges when said sphere is inserted such that the distance from a point on the front wall panel where the inner surface of the carton contacts the sphere to an opposite point on said rear wall panel where the inner surface of the carton contacts the sphere is the same as the diameter of said sphere.

7. The carton according to claim 6 wherein the distance from a point on the top edge of said first sidewall panel where the inner surface of the carton contacts the sphere to a point on the top edge of said second sidewall panel where the inner surface of the carton contacts the sphere is the same as the diameter of said sphere.

8. A carton construction comprising:

a front wall panel having a top edge and a bottom edge and a pair of side edges parallel to each other;

a rear wall panel having a top edge and a bottom edge and a pair of side edges parallel to each other;

a first sidewall panel connected to one of said side edges on each of said front and rear wall panel;

a second sidewall panel connected to the opposite edge of said front wall panel; said side wall panels having a top edge and a bottom edge;

a top panel foldably connected to one of said wall panels;

a bottom panel foldably connected to the other of said wall panels;

a centrally located opening on said front and rear wall panels adapted permit a portion of a spherical article housed within the carton construction to be displayed;

a tuck end flap on each of said top and bottom panels and wherein the area of the top panel is at least equal to or greater than the cross sectional area of a sphere to be packaged therein and wherein the angle formed by the front panel and each of the sidewall panels is 90° and the angle formed by the rear panel and each of the sidewall panels is 90°.

9. The carton according to claim 4 wherein the angles formed by $h_1$ and $w_1$; $h_1$, and $w_2$; $h_2$ and $w_1$; and $h_2$ and $w_2$ are each 90°.

* * * * *